US008633784B2

(12) United States Patent
Ihla et al.

(10) Patent No.: US 8,633,784 B2
(45) Date of Patent: Jan. 21, 2014

(54) MISALIGNMENT TOLERANT CONTACTLESS RF COUPLING DEVICE

(75) Inventors: Conrad Ihla, Zimmerman, MN (US); Robert Charles Becker, Eden Prairie, MN (US); Glen Backes, Maple Grove, MN (US); Alan Cornett, Andover, MN (US); Matthew S. Marcus, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 305 days.

(21) Appl. No.: 13/174,178

(22) Filed: Jun. 30, 2011

(65) Prior Publication Data

US 2013/0002376 A1 Jan. 3, 2013

(51) Int. Cl.
*H01P 3/08* (2006.01)

(52) U.S. Cl.
USPC ..... 333/24 R; 333/116; 333/238; 333/246

(58) Field of Classification Search
USPC ..... 333/116, 33, 238, 246, 24 R
See application file for complete search history.

(56) References Cited

U.S. PATENT DOCUMENTS 3,771,075 A * 11/1973 Phelan ..... 333/246
5,093,639 A * 3/1992 Franchi et al. ..... 333/24 R
6,545,572 B1 * 4/2003 Ohta et al. ..... 333/246

* cited by examiner

*Primary Examiner* — Robert Pascal
*Assistant Examiner* — Kimberly Glenn
(74) *Attorney, Agent, or Firm* — Schwegman, Lundberg & Woessner, P.A.

(57) ABSTRACT

Some embodiments relate to a contactless RF coupling device that includes a first substrate and a second substrate. The RF coupling device may provide a broadband, low loss electrical connection without mechanical contact as would a conventional mechanical connector. The first substrate includes a first ground plane on one side and a first transmission line on an opposing side. The first transmission line includes an enlarged first coupling member at an end of the first transmission line. The second substrate includes a second ground plane on one side and a second transmission line on an opposing side. The second transmission line includes an enlarged second coupling member at an end of the second transmission line. The first ground plane may not extend under the first coupling member and the second ground plane may include an opening that is aligned with the second coupling member.

16 Claims, 5 Drawing Sheets

MISALIGNMENT TOLERANT CONTACTLESS RF COUPLING DEVICE

GOVERNMENT FUNDING

This invention was made with Government support under Contract Number: **-*7211-***. The Government has certain rights in the invention.

TECHNICAL FIELD

Embodiments relate to a contactless coupling device. More specifically, embodiments relate to a misalignment tolerant contactless RF coupling device.

BACKGROUND

There is frequently a need to couple RF devices together with minimal loss. A mechanical connector is typically employed for such a connection. There are many circumstances where a mechanical connector is impractical, or mechanical variability in the position of the connector is desirable.

The typical approach is to use a specialized mechanical connector that that has spring loaded centering rings to initially align the connectors and allow them to move around after mating. One drawback with such specialized connectors is that they are both expensive and the mechanical structures required to permit movement make the entire assembly cumbersome.

Another approach is to use contactless coupling devices. Existing contactless devices typically include coupling members that are magnetically coupled together to transfer energy between the coupling members.

One of the drawbacks with existing contactless coupling devices that include magnetically coupled members is that magnetic coupling devices usually require some sort of magnetic core, such as a ferrite core, in order to contain the magnetic flux and thereby minimize insertion loss. Magnetic coupling devices can also be quite large if they are intended to couple low frequency signals and the magnetic core material can add substantially to the size and weight of the coupler.

A related type of magnetic coupler is a transmission line coupler. This type of coupler usually operates over a limited range of frequencies and requires a relatively long coupling region in order to achieve low loss coupling.

DETAILED DESCRIPTION

Figure 1:
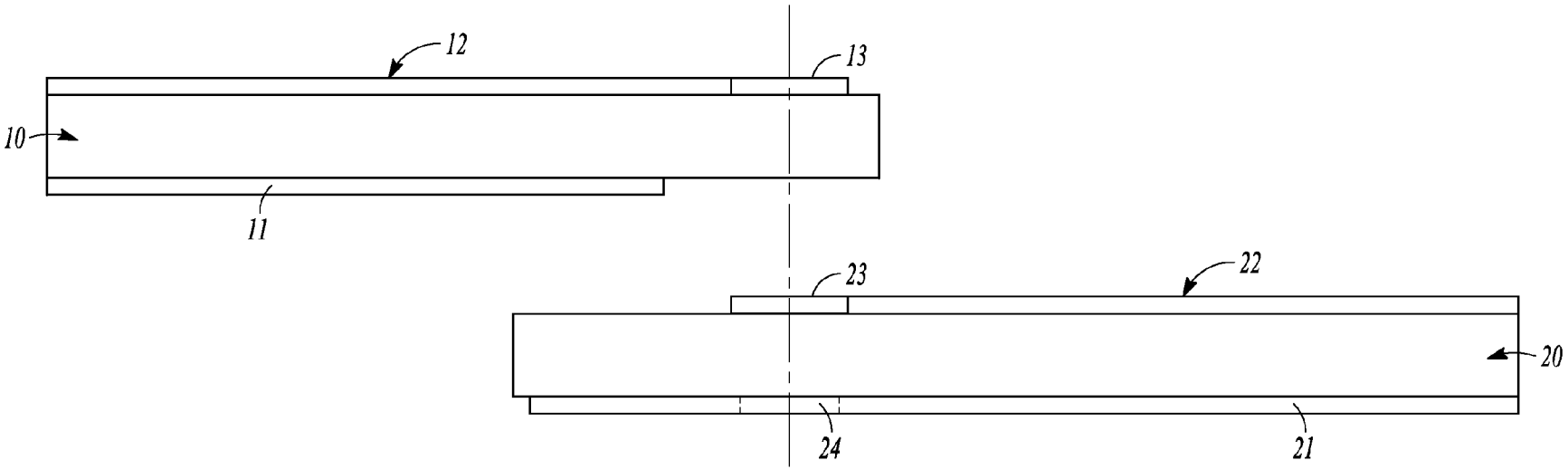
FIG. 1 is a schematic side section view of an example contactless RF coupling device.
Figure 2:
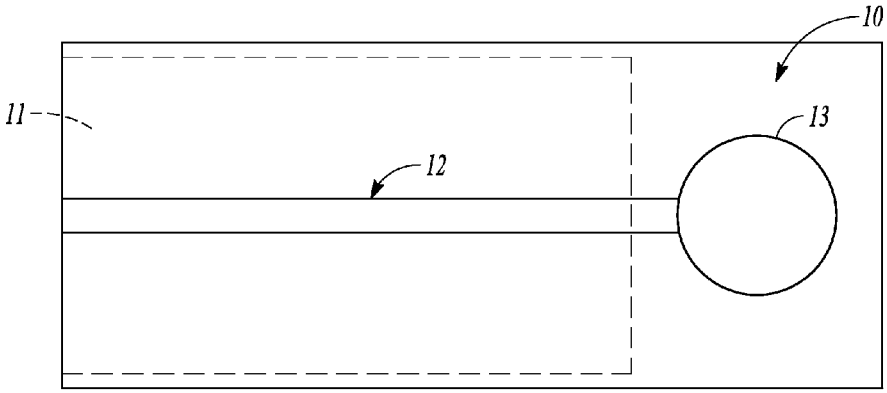
FIG. 2 is a top view of an example first substrate that may be used in the contactless RF coupling device shown in FIG. 1.
Figure 3:
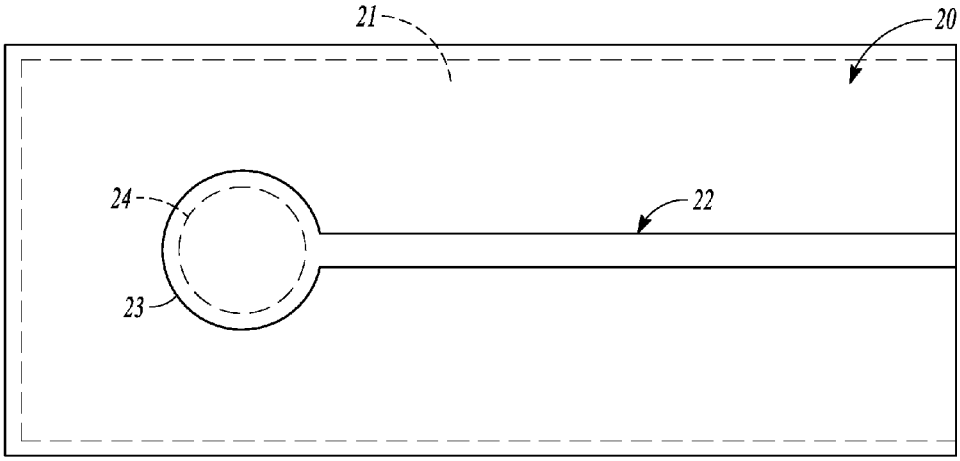
FIG. 3 is a top view of an example second substrate that may be used in the contactless RF coupling device shown in FIG. 1.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

FIGS. 1-7 illustrate all, or part, of a contactless RF coupling device 1 that includes a first substrate 10 and a second substrate 20. The RF coupling device 1 may provide a broadband, low loss electrical connection without mechanical contact as would a conventional mechanical connector.

The RF coupling device 1 allows two RF devices to be coupled together with minimal loss (e.g., across a thin dielectric barrier in some applications). The RF coupling device 1 may provide low loss coupling between system components (not shown) while tolerating a modest amount of positional (x,y,z) translations from perfect alignment of the first substrate 10 and second substrate 20.

The first substrate 10 includes a first ground plane 11 on one side of the first substrate 10 and a first transmission line 12 (e.g., a microstrip) on an opposing side of the first substrate 10. The first transmission line 12 includes an enlarged first coupling member 13 at an end of the first transmission line 12.

The second substrate 10 includes a second ground plane 21 on one side of the second substrate 20 and a second transmission line 22 (e.g., a microstrip) on an opposing side of the second substrate 20. The second transmission line 22 includes an enlarged second coupling member 23 at an end of the second transmission line 22 to transfer an electric field from the enlarged first coupling member 13 to the enlarged second coupling member 23. The enlarged first coupling member 13 and the enlarged second coupling member 23 are formed of a conductive material.

In the example embodiment that is illustrated in FIGS. 1-7, the enlarged first coupling member 13 is an enlarged first coupling disk 13 and the enlarged second coupling member 23 is an enlarged second coupling disk 23. It should be noted that although the enlarged first and second coupling members 13, 23 are shown as enlarged circular disks 13, 23 which are the same size, other sizes and shapes are contemplated for the enlarged first and second coupling members 13, 23.

In some embodiments, the first enlarged coupling circular disk 13 has a diameter that is between one and ten times as great as a distance between the first enlarged coupling circular disk 13 and the second enlarged coupling circular disk 23 and the second coupling circular disk 23 has a diameter that is between one and ten times as great as a distance between the first enlarged coupling circular disk 13 and the second enlarged coupling circular disk 23. As an example embodiment, it may be desirable that the capacitance between the first enlarged coupling circular disk 12 and the second enlarged coupling circular disk 23 to have a reactance of less than one-tenth of the characteristic impedance of the first and second transmission lines 12, 22.

Although the first transmission line 12 is shown in FIGS. 1-7 as being same size as the second transmission line 22, it should be noted that the first and second transmission lines 12, 22 may be other sizes and/or shapes such that the first and second transmission lines 12, 22 have the desired characteristic impedances as may be required for the systems to which they may be connected. In some embodiments, it may be possible to have the characteristic impedance of the first transmission line 12 differ from the characteristic impedance of the second transmission line 22. In such a case, one may select the size of the first and second enlarged coupling circular disks to have a diameter such that the capacitive reactance of the capacitance between the first enlarged coupling circular disk 12 and the second enlarged coupling circular disk 23 is less than one-tenth of the lower of the two characteristic impedances of the first and second transmission line lines 12, 22.

As an example, the diameter of the enlarged coupling circular disks 13, 23 may be approximately 4-5 times the width of the attached corresponding transmission lines 12, 22.

Embodiments are contemplated where the first transmission line 12 has a characteristic impedance between 10 and 200 ohms and the second transmission line 22 has a characteristic impedance between 10 and 200 ohms. In some embodiments, the lower limit represents a practical limitation due to excessive width of the first and second transmission line lines 12, 22, while the upper limit represents a practical limitation due to excessive resistance, and therefore loss in, first and second transmission line lines 12, 22. It is contemplated that these limitations may change in the future as new materials for first and second substrates 11, 21 become available as well as new materials for first and second transmission lines 12, 22.

Figure 4:
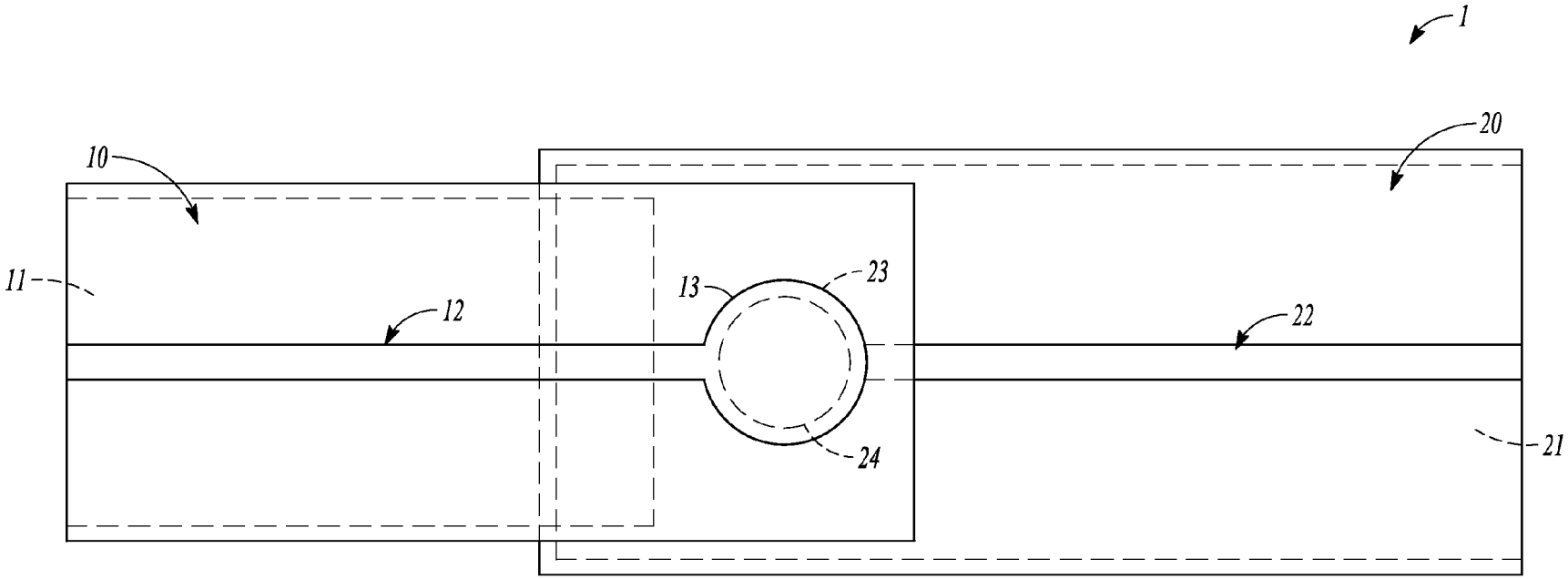
FIG. 4 is a top view of the contactless RF coupling device shown in FIG. 1.
Figure 5:
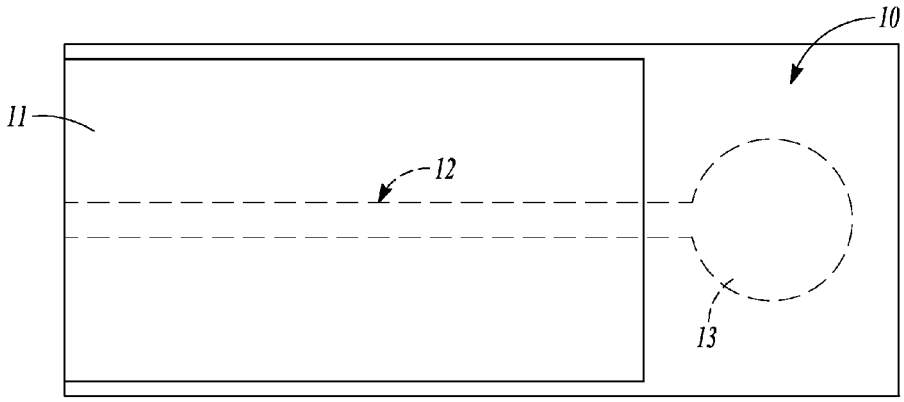
FIG. 5 is a bottom view of an example first substrate that may be used in the contactless RF coupling device shown in FIG. 1.
Figure 6:
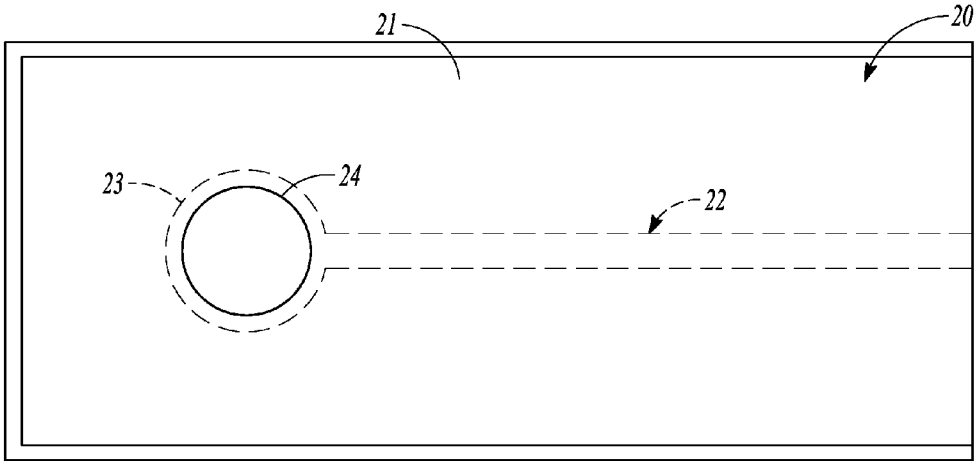
FIG. 6 is a bottom view of an example second substrate that may be used in the contactless RF coupling device shown in FIG. 1.
Figure 7:
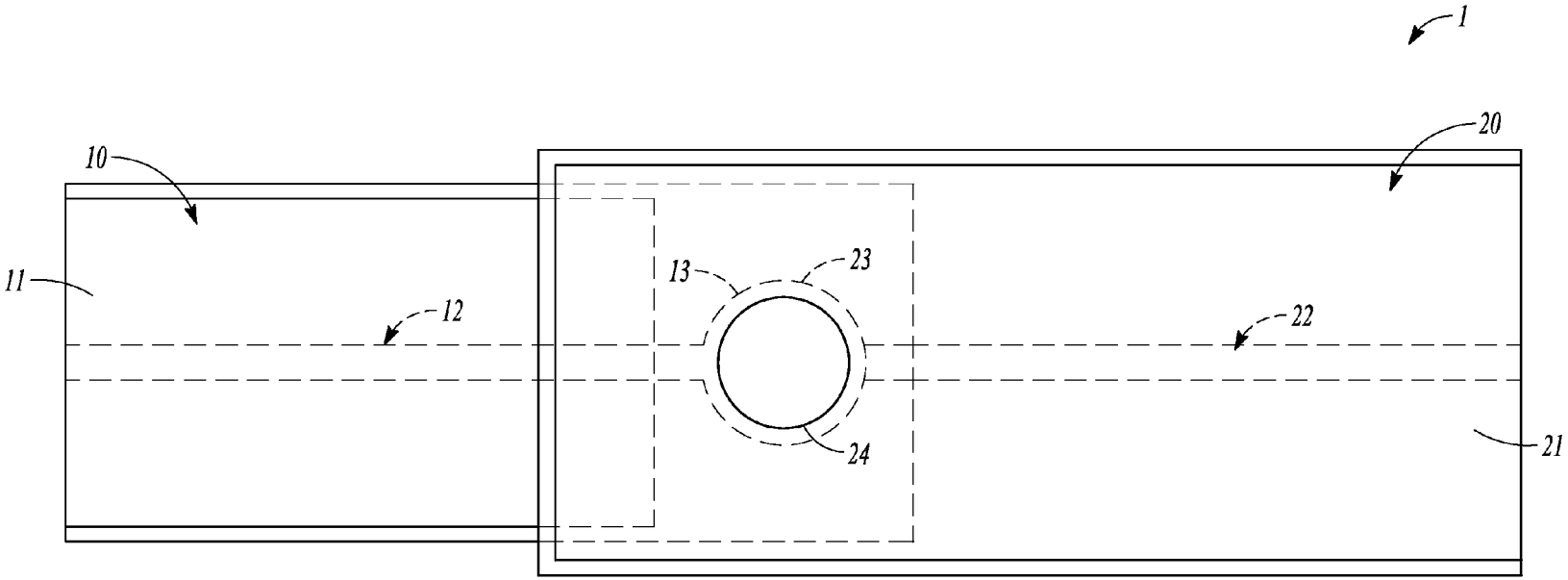
FIG. 7 is a bottom view of the contactless RF coupling device shown in FIG. 1.

As shown most clearly in FIGS. 1, 4 and 7, the first ground plane 11 does not extend under the first enlarged coupling member 13 and the second ground plane 23 includes an opening 24 that is aligned with the enlarged second coupling member 23. The first ground plane 11 may be relieved from the first enlarged coupling member 13 in order to reduce the capacitance of the first enlarged coupling member 13 to ground. This relief may minimize any impedance discontinuity caused by the capacitance to ground of the first enlarged coupling member 13 and increases the coupling between the first enlarged coupling member 13 and the second enlarged coupling member 23.

The second ground plane 21 under the second enlarged coupling member 23 is relieved so that the resulting stack-up of conductive material remains similar in topology to a transmission line instead of a triplate or stripline topology. In some embodiments, the second ground plane 21 relief under the second enlarged coupling member 23 may be in the form of opening 24 in the second ground plane 21.

The opening 24 in the second ground plane 21 may reduce the capacitance of the second enlarged coupling member 23 to the second ground plane 21. If opening 24 were not in the second ground plane 21, the capacitance of the second enlarged coupling member 23 to the second ground plane 21 might decrease the characteristic impedance of the second transmission line 22 and this would increase the loss in the coupler. Opening 24 may reduce the capacitance of the second enlarged coupling member to the second ground plane 21 and thereby increase the characteristic impedance of the second transmission line 22 that is formed between the second ground plane 21 and the second enlarged coupling member 23 to a level similar to the first transmission line 11. Therefore, the opening 24 may reduce the impedance discontinuity that would otherwise occur if the second ground plane 21 was fully under the second enlarged coupling member 23 and thereby reduces the signal loss of the coupler.

In some embodiments, the first ground plane 11 overlaps the second ground plane 21 with an area that is at least equal to an area of the enlarged first coupling member 13. The first and second ground planes 11, 21 may be overlapped such that the first and second ground planes 11, 21 function as a single, connected ground plane due to a sufficiently large overlap capacitance between the first and second ground planes 11, 21.

As an example, the AC impedance of the overlap capacitance may be small (i.e., less than 1/10th of the impedance of the first transmission line 12 which may be used to feed energy to the contactless RF coupling device 1. In addition, it may be desirable to have the AC impedance due to the capacitive coupling between first ground plane 11 and second ground plane 21 be much less than the AC impedance due to the capacitive coupling between the first enlarged coupling member 13 and the second enlarged coupling member 23. As such, if the AC impedance due to the capacitive coupling between the first enlarged coupling member 13 and the second enlarged coupling member 23 is $1/10^{th}$ the characteristic impedance of the first transmission line 12, then it may be desirable to have the AC impedance due to the capacitive coupling between first ground plane 11 and second ground plane 21 to be at least $1/20^{th}$ of the AC impedance due to the capacitive coupling between the first enlarged coupling member 13 and the second enlarged coupling member 23 so that there is effectively no potential difference between the first and second ground planes 11, 21.

Other embodiments relate to a method of transferring energy between devices. The method includes providing a first substrate 10 that includes a first ground plane 11 on one side of the first substrate 10 and a first transmission line 12 on an opposing side of the first substrate 10. The first transmission line 12 includes an enlarged first coupling member 13 at an end of the first transmission line 12.

The method further includes positioning a second substrate 20 that includes a second ground plane 21 on one side of the second substrate 20 and a second transmission line 22 on an opposing side of the second substrate 20 near the first substrate 10. The second transmission line 22 includes an enlarged second coupling member 23 at an end of the second transmission line 22.

The method further includes transferring an electric field from the enlarged first coupling member 13 to the enlarged second coupling member 23. In some embodiments, positioning the second substrate 20 includes aligning the enlarged first coupling member 13 with the enlarged second coupling member 23.

In some embodiments, the first substrate 10 and the second substrate will be positioned next to one another such that a sufficient amount of capacitive coupling occurs to transfer a desired amount of electrical energy from the first transmission line 12 to the second transmission 22.

Positioning the second substrate 20 may include aligning an opening 24 in the second ground plane 21 with the enlarged second coupling member 23. Aligning the opening 24 in the second ground plane 21 with the enlarged second coupling member 23 may reduce the capacitive coupling between the enlarged second coupling member 23 and the second ground plane 21.

In addition, positioning the second substrate 20 may include overlapping the first ground plane 11 with second ground plane 21. Overlapping the first ground plane 11 with second ground plane 21 may create a circuit ground in the second ground plane 21 that is equivalent to a circuit ground in the first ground plane 11.

The Abstract is provided to comply with 37 C.F.R. §1.72(b) to allow the reader to quickly ascertain the nature and gist of the technical disclosure. The Abstract is submitted with the understanding that it will not be used to limit the scope or meaning of the claims.

The invention claimed is:

1. A contactless RF coupling device comprising:

a first substrate that includes a first ground plane on one side of the first substrate and a first transmission line on an opposing side of the first substrate, the first transmission line including an enlarged first coupling member at an end of the first transmission line; and a second substrate that includes a second ground plane on one side of the second substrate and a second transmission line on an opposing side of the second substrate, the second transmission line including an enlarged second coupling member at an end of the second transmission line to transfer an electric field from the enlarged first coupling member to the enlarged second coupling member, wherein the enlarged first coupling member is an enlarged first coupling disk and the enlarged second coupling member is an enlarged second coupling disk, wherein the enlarged first coupling disk is a circular disk and the enlarged second coupling disk is a circular disk, wherein the enlarged first coupling circular disk has a diameter that is between one and ten times as great as a distance between the enlarged first enlarged coupling member and the enlarged second enlarged coupling member and the enlarged second coupling circular disk has a diameter that is between one and ten times as great as the distance between the enlarged first enlarged coupling member and the enlarged second enlarged coupling member.

2. The contactless RF coupling device of claim 1 wherein the first transmission line has a characteristic impedance between 10 and 200 ohms and the second transmission line has a characteristic impedance between 10 and 200 ohms.

3. The contactless RF coupling device of claim 1 wherein the first transmission line has a characteristic impedance between 10 and 200 ohms and the second transmission line has a characteristic impedance between 10 and 200 ohms.

4. The contactless RF coupling device of claim 1 wherein the first transmission line is the same size as the second transmission line.

5. The contactless RF coupling device of claim 1 wherein the enlarged first coupling member is the same size as the enlarged second coupling member.

6. The contactless RF coupling device of claim 1 wherein the enlarged first coupling member and the enlarged second coupling member are formed of a conductive material.

7. A contactless RF coupling device comprising:

a first substrate that includes a first ground plane on one side of the first substrate and a first transmission line on an opposing side of the first substrate, the first transmission line including an enlarged first coupling member at an end of the first transmission line; and a second substrate that includes a second ground plane on one side of the second substrate and a second transmission line on an opposing side of the second substrate, the second transmission line including an enlarged second coupling member at an end of the second transmission line to transfer an electric field from the enlarged first coupling member to the enlarged second coupling member, wherein the first ground plane does not extend under the first enlarged coupling member and the second ground plane includes an opening that is aligned with the enlarged second coupling member.

8. The contactless RF coupling device of claim 7 wherein the opening in the second ground plane is smaller than the enlarged second coupling member.

9. The contactless RF coupling device of claim 8 wherein the enlarged first coupling member is a circular disk that has a diameter that is between one and ten times as great as a distance between the enlarged first enlarged coupling member and the enlarged second coupling member and the enlarged second coupling member is a circular disk that has a diameter that is between one and ten times as great as the distance between the enlarged first coupling member and the enlarged second coupling member.

10. The contactless RF coupling device of claim 7 wherein the first ground plane overlaps the second ground plane.

11. The contactless RF coupling device of claim 10 wherein the first ground plane overlaps the second ground plane with an area that is at least equal to an area of the enlarged first coupling member.

12. A method of transferring energy between devices, the method comprising:

providing a first substrate that includes a first ground plane on one side of the first substrate and a first transmission line on an opposing side of the first substrate, the first transmission line including an enlarged first coupling member at an end of the first transmission line; and positioning a second substrate that includes a second ground plane on one side of the second substrate and a second transmission line on an opposing side of the second substrate near the first substrate, the second transmission line including an enlarged second coupling member at an end on the second transmission line; and transferring an electric field from the enlarged first coupling member to the enlarged second coupling member, wherein the positioning a second substrate includes overlapping the first ground plane with second ground plane to create a circuit ground in the second ground plane that is equivalent to a circuit ground in the first ground plane.

13. The method of claim 12 wherein the positioning a second substrate includes aligning an opening in the second ground plane with the enlarged second coupling member to reduce the capacitive coupling between the enlarged second coupling member and the second ground plane.

14. The method of claim 12 wherein the overlapping the first ground plane with second ground plane includes overlapping the first ground plane with second ground plane with an area that is at least equal to an area of the enlarged first coupling member.

15. A method of transferring energy between devices, the method comprising:

providing a first substrate that includes a first ground plane on one side of the first substrate and a first transmission line on an opposing side of the first substrate, the first transmission line including an enlarged first coupling member at an end of the first transmission line; and positioning a second substrate that includes a second ground plane on one side of the second substrate and a second transmission line on an opposing side of the second substrate near the first substrate, the second transmission line including an enlarged second coupling member at an end on the second transmission line; and transferring an electric field from the enlarged first coupling member to the enlarged second coupling member, wherein the positioning a second substrate includes aligning the enlarged first coupling member with the enlarged second coupling member.

16. A contactless RF coupling device comprising:

a first substrate that includes a first ground plane on one side of the first substrate and a first transmission line on an opposing side of the first substrate, the first transmission line including an enlarged first coupling circular disk at an end of the first transmission line;

a second substrate that includes a second ground plane on one side of the second substrate and a second transmission line on an opposing side of the second substrate, the second transmission line including an enlarged second coupling circular disk at an end of the second transmission line to transfer an electric field from the enlarged first coupling member to the enlarged second coupling member, the enlarged second coupling circular disk having a diameter that is between one and ten times as great as a distance between the first enlarged coupling member and the second enlarged coupling member, and the enlarged first coupling circular disk having a diameter that is between one and ten times as great as the distance between the first enlarged coupling member and the second enlarged coupling member;

wherein the first transmission line is the same width as the second transmission line and the enlarged first coupling circular disk is the same size as the enlarged second coupling circular disk; and wherein the first ground plane does not extend under the first enlarged coupling circular disk and the second ground plane includes an opening that is aligned with the enlarged second coupling circular disk, the first ground plane overlapping the second ground plane with an area that is at least equal to an area of the enlarged first coupling circular disk, the opening in the second ground plane being the same size as the enlarged second coupling circular disk.

* * * * *